United States Patent [19]

Lin

[11] Patent Number: 5,073,846

[45] Date of Patent: Dec. 17, 1991

[54] SAFETY DEVICE FOR HALOGEN LIGHT

[76] Inventor: Ming I. Lin, No. 7, Lane 97, Ho Ping Rd., Lu Chou Hsiang, Taipei Hsien, Taiwan

[21] Appl. No.: 603,412

[22] Filed: Oct. 26, 1990

[51] Int. Cl.[5] ..... F21K 5/20

[52] U.S. Cl. ..... 362/263; 362/375; 362/394; 362/802; 200/61.76; 439/188

[58] Field of Search ..... 362/263, 265, 295, 802, 362/155, 221, 226, 295, 394; 200/60, 61.76, 341; 439/188, 912

[56] References Cited

U.S. PATENT DOCUMENTS 2,164,149 6/1939 Underdorfel ..... 200/61.76
3,671,739 6/1972 McCain ..... 362/375
4,554,618 11/1985 Bafunno et al. ..... 362/155
4,979,083 12/1990 Takano et al. ..... 200/61.76
4,980,809 12/1990 Baldwin et al. ..... 362/802

FOREIGN PATENT DOCUMENTS 2143557 3/1973 Fed. Rep. of Germany ..... 362/394

*Primary Examiner*—Ira S. Lazarus
*Assistant Examiner*—D. M. Cox
*Attorney, Agent, or Firm*—Oltman and Flynn

[57] ABSTRACT

A safety device for halogen lights constructed with a pair of bodies each having a spring, rod, upper connecting plate, lower connecting plate, and a set of securing members. By pushing the rod downwardly with a plate, the upper connecting plate contacts with the lower connecting plate and forms a loop therefrom.

1 Claim, 6 Drawing Sheets

SAFETY DEVICE FOR HALOGEN LIGHT

BACKGROUND OF THE INVENTION

The present invention relates to a safety device for halogen lights.

FIG. 6 of the drawings shows a conventional device for a halogen light. It can be seen that the safety device for the light has a L-shaped body. The body is mainly constructed by a U-groove (80) for holding the light wherein a holder (not shown) enables a light to be inserted between the two bodies. Because prior halogen lights were not provided with shields or waterproofing to prevent shock, users were potentially exposed to this hazard. Halogen lights belong to high-current electrical appliances, and one has to turn them down before replacing the lights or repairing them. Furthermore, the bodies are not provided any insulator, and one has to turn them on to test whether the light is functioning normally. Generally, switches and lights are arranged in a way that one cannot carry out the job alone, i.e., it is inconvenient and time-consuming to replace or repair the damaged lights.

It is the purpose of this present invention, therefore, to mitigate and/or obviate the above-mentioned drawback in the manner set forth in the detailed description of the preferred embodiment.

SUMMARY OF THE INVENTION

Accordingly, it is an object of this invention to provide a safety device for halogen lights which is not only safe, but also convenient for any one to carry out assembly, performance testing and maintenance.

A further object of this invention is to provide a device for protecting halogen lights with a safety switch right on the body which not only saves space, but also makes it easy to determine whether or not the light is functioning normally.

Further objects and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

In reference to FIGS. 1 through 5, it can be seen that the safety device for halogen lights in accordance with the present invention is substantially symmetrical with respect to a middle point of the light, i.e., symmetrical right and left portions. It should be known that the following detailed description will only describe the present invention with respect to a singular portion, the left portion, and that the description for the right portion of the invention will be identical.

Figure 1:
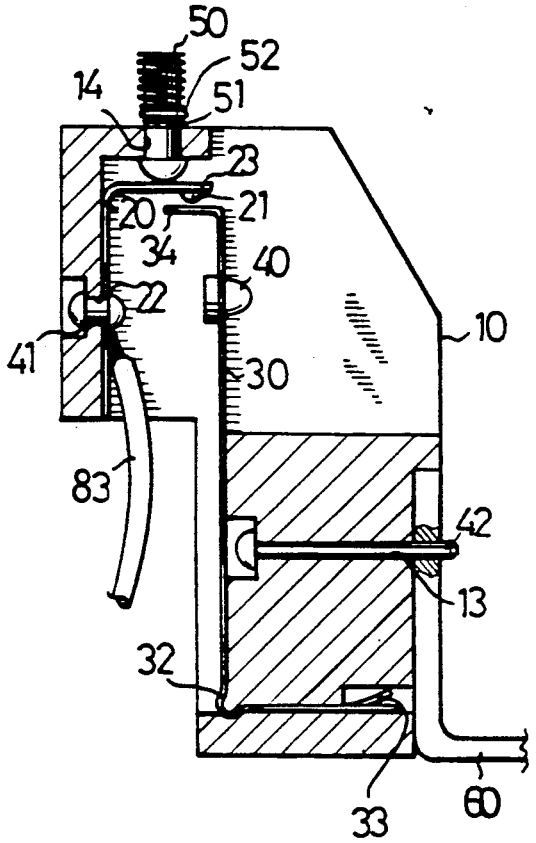
FIG. 1 is a cross-sectional view of a body in accordance with the present invention.
Figure 2:
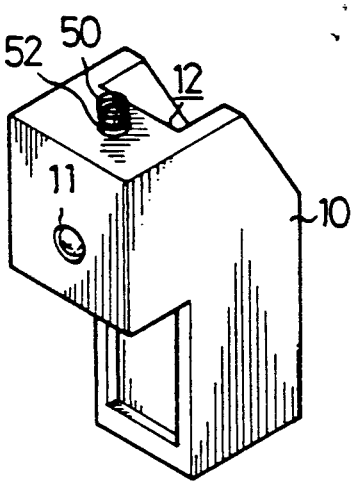
FIG. 2 is a perspective view of the body shown in FIG. 1.
Figure 3:
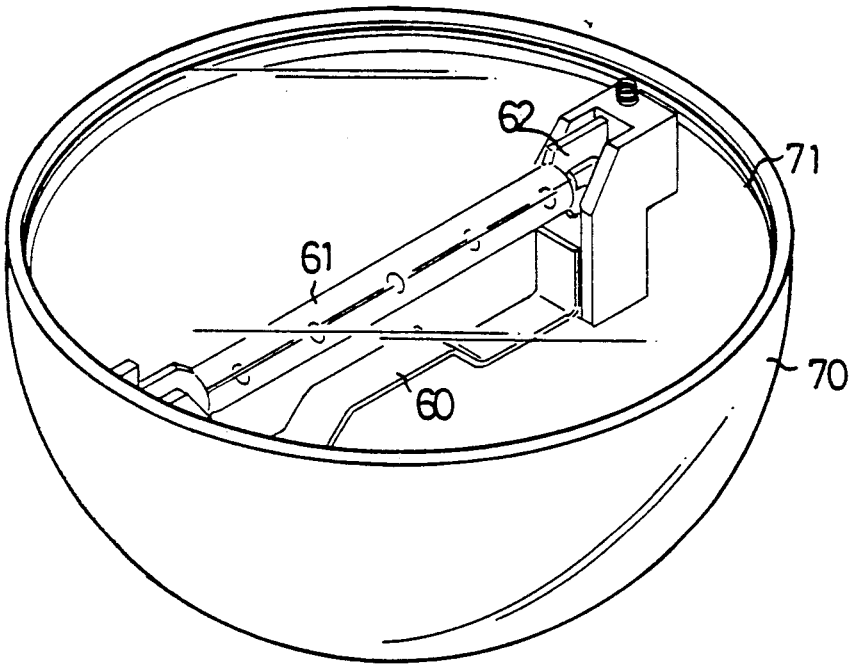
FIG. 3 is a partial perspective view of the safety device for halogen light in accordance with the present invention.
Figure 4:
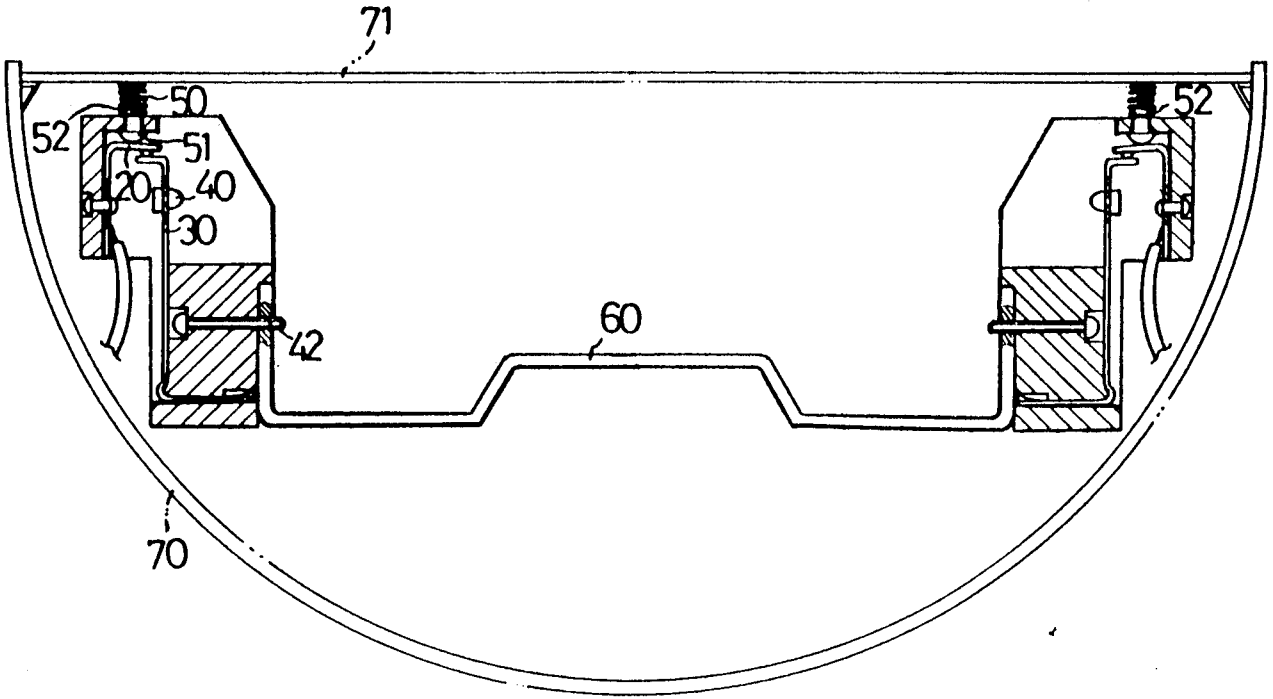
FIG. 4 is a cross-sectional view of the safety device for halogen light shown in FIG. 3.
Figure 5:
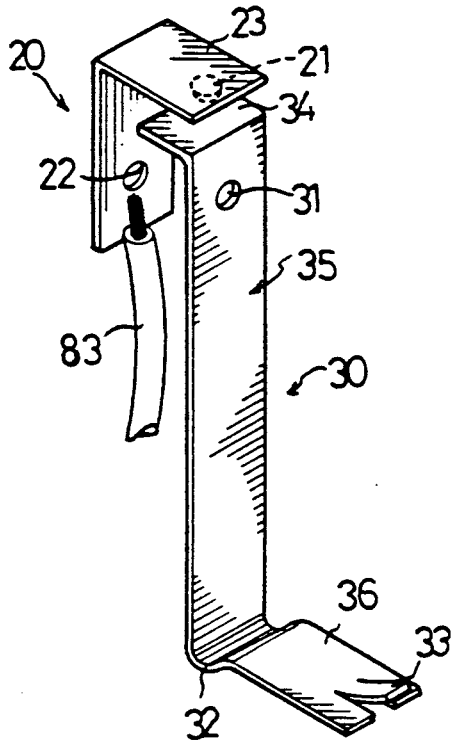
FIG. 5 is a partial exploded view of the body in accordance with the present invention.
Figure 6:
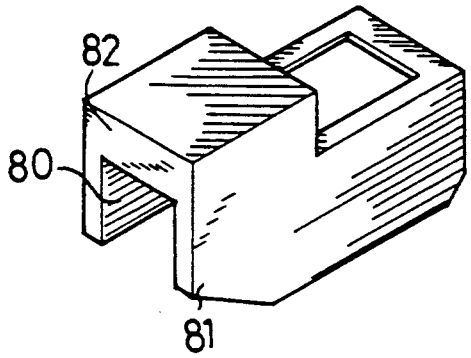
FIG. 6 PRIOR ART
FIG. 6 is a perspective view of a well known body.

Referring to FIGS. 1, 2 and 5, the safety device for halogen lights in accordance with the present invention is constructed with a L-shaped body (10). A first pin hole (11) is provided on an upper vertical side surface of the body (10), whereas a U-groove (12) is provided on an opposite vertical side surface of the body (10). A second pin hole (14) is provided on a partially cutoff top surface of the body (10), with a rod (51) provided inside. The rod (51) has a hemispherical lower portion which has a diameter larger than an upper end thereof, rendering the parameter of the lower portion of the rod (51) to lodge within an inner wall of the body (10) and an upper outer ring (52). A spring (50) is provided to envelop most of the upper portion of the rod (51), with its upper portion inserted into the outer ring (52) of the rod (51). An upper conducting plate (20) attached to the inside of the body (10) is provided over the first pin hole (11), the upper conducting plate (20) has a vertical plate and a right angle bend (23) extending from an upper end thereof and lies directly under the second pin hole (14). A groove (21) is provided on the right angle bend (23), and the right angle bend (23) contacts with the rod (51). A hole (22) is provided on the upper conducting plate (20) to align with the first pin hole (11) such that a pin (41) can pass therethrough and is attached to a wire (83) (see FIG. 5).

A lower conducting plate (30) comprises an upper right angle bend (34), a middle vertical plate (35) and a lower curved bend (36) joined together by ends, is provided below the upper conducting plate (20) and maintains a proper distance from the groove (21). A hole (31) having a holder (40) to hold a light (61) is provided on the middle vertical plate (35). The lower curved bend (36) having a curve (32) and an end portion with a central piece (33) extending upwardly against the body (10) to fix therein.

A cotter hole (13) is provided on the lower side of the body (10), allowing a cotter pin (42) to pass therethrough and fix to a hat-like holder thereby (60).

A safety device for halogen light in accordance with this application may locate in a light mask (70). While masking the light mask (70) with a plate (71), the spring (50) together with the rod (51) will be pushed downward, rendering the groove (21) of the upper conducting plate (20) to contact with the upper right angle bend (34) of the lower conducting plate (30), forming a loop. A light (61) will be provided between the two holders (40) of the lower conducting plate (30).

Accordingly, the safety device of the halogen light provides a safety measure not only to protect users from shock, but also to save a lot of time when repairing or replacing halogen lights.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A safety device for halogen lights comprising:

a body having a vertical side surface with a lower half portion thereof cut off, an opposite vertical side surface with a groove formed in an upper portion thereof, and a partially cut off top surface, said vertical side surface and said top surface each being provided with a pin hole, said opposite vertical side surface being provided with a cotter hole on a lower portion thereof;

a rod having a hemi-spherical lower portion and an upper outer ring provided through said pin hole of said top surface, said lower portion of said rod bearing against an inner wall of said body;

a spring being provided to envelop most of an upper portion of said rod and having an upper end inserted into said upper outer ring and a lower end bearing against said top surface of said body;

an upper conducting plate having a vertical plate and a right angle bend extending from an upper end of said vertical plate, said vertical plate having a hole to align with said pin hole on said vertical side surface of said body for a pin to pass therethrough and interlock said upper conducting plate into said body thereby; said upper conducting plate further having a groove provided on said right angle bend;

a lower conducting plate having an upper right angle bend, a middle vertical plate, and a lower curved bend, said lower conducting plate being provided slightly below said groove of said upper conducting plate so as to form a loop when said groove is pushed by said rod, said middle vertical plate having a hole to encompass a holder for holding a light, said lower curved bend having a curve between said lower curve bend and said middle plate and a middle piece extending upwardly to contact against said body and fix therein;

a hat-like holder having a hole to align with said cotter hole for a cotter pin to pass therethrough and fix thereby; and a light mask being provided for said body with a plate to push down said spring together with said road and said upper conducting plate to form a loop therein.

* * * * *